United States Patent [19]

Patterson et al.

[11] Patent Number: 4,777,667

[45] Date of Patent: Oct. 18, 1988

[54] FLIP BILL CAP

[76] Inventors: Barton H. Patterson, P.O. Box 88205, Sioux Falls, S. Dak. 57105; George Spector, 233 Broadway Rm 3815, New York, N.Y. 10007

[21] Appl. No.: 48,270

[22] Filed: May 11, 1987

[51] Int. Cl.[4] ..... A42B 1/24

[52] U.S. Cl. ..... 2/199; 446/27; 40/586

[58] Field of Search ..... 2/199, 195, 196, 175, 2/177, 12, 10, 8, 453; 446/27; 40/586

[56] References Cited

U.S. PATENT DOCUMENTS

| | | | |
|---|---|---|---|
| 2,648,847 | 8/1953 | Crowder | 446/27 X |
| 2,678,369 | 5/1954 | Van Hook | 2/8 X |
| 4,011,594 | 3/1977 | Guilbaud et al. | 2/8 |
| 4,262,367 | 4/1981 | Herrin | 40/586 X |
| 4,268,918 | 5/1981 | Lee | 2/199 |

*Primary Examiner*—Peter Nerbun

[57] ABSTRACT

A flip bill cap is provided and consists of the bill portion raised to disclose an entertaining and unique advertising message thereon. The bill portion is activated in one instance by the pull of an elongated string and in another instance by a solenoid. In a modification the bill portion includes an indicia viewing track therein.

1 Claim, 1 Drawing Sheet

FLIP BILL CAP

BACKGROUND OF THE INVENTION

The instant invention relates generally to hats and more specifically it relates to a flip bill cap.

Numerous hats have been provided in prior art that are adapted to be used for novelty amusement and advertising purposes. For example U.S. Pat. Nos. 1,619,007; 2,593,188 and 2,648,847 all are illustrative of such prior art. While these units may be suitable for the particular purpose to which they address, they would not be as suitable for the purposes of the present invention as heretofore described.

SUMMARY OF THE INVENTION

A primary object of the present invention is to provide a flip bill cap that will overcome the shortcomings of the prior art devices.

Another object is to provide a flip bill cap whereby the bill portion may be raised to disclose an entertaining and unique advertising message thereon.

An additional object is to provide a flip bill cap whereby the bill portion can be activated in one instance by the pull of an elongated string and in another instance by a solenoid.

A further object is to provide a flip bill cap that is simple and easy to use.

A still further object is to provide a flip bill cap that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
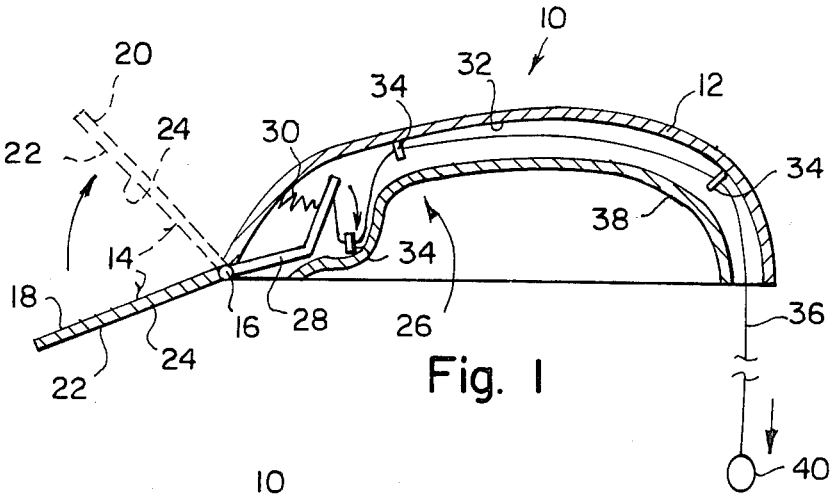
FIG. 1 is a cross sectional view through a cap with invention therein being a string to activate movement of the bill portion.

Turning now descriptively to the drawings, in which similar reference characters denote similar elements throughout the several views, FIG. 1 illustrates a flip bill cap 10 that contains a crown portion 12 to be worn on head of a person (not shown). A bill portion 14 is pivotally affixed at 16 to the crown portion 12 and adapted to assume a downwardly extended position 18 and an angularly upright position 20 shown in phantom. Indicia 22 is on underside 24 of the bill portion 14 whereby when the bill portion 14 is placed in the angularly upright position 20 the indicia 22 becomes apparent. A device 26 is provided for placing the bill portion

14 in the angularly upright position 20 and includes an arm 28 extending inwardly into the crown portion 12 from the bill portion 14. A spring 30 extends between free end of the arm 28 and underside 32 of the crown portion 12 to normally keep the bill portion 14 in the downwardly extended position 18. A plurality of eyelets 34 are spaced apart and secured to the underside 32 of the crown portion 12. An elongated string 36 is affixed at one end to the free end of the arm 28 and extends through eyelets 34. A liner 38 is placed within the crown portion lZ to cover the arm 28, eyelets 34 and elongated string 36. A ring 40 is affixed to free end of the elongated string 36 so that when the ring 40 is manually pulled the bill portion 14 will be placed in the angularly upright position 20 in which the indicia 22 becomes apparent.

Figure 2:
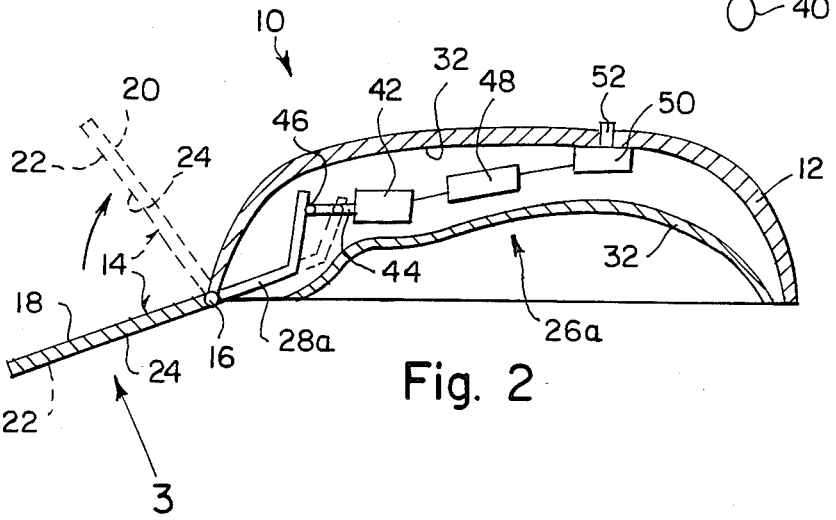
FIG. 2 is a cross sectional view through a cap of a modification therein being a solenoid operating the movement of the bill portion.

In FIG. 2 another device **26*a* is provided and includes an arm 28*a* extending inwardly into the crown portion 12 from the bill portion 14. A solenoid 42 has a shaft 44 pivotall affixed at 46 to the arm 28*a*. The shaft 44 is spring biased outwardly to normally keep the bill portion 14 in the downwardly extended position 18. A battery 48 is electrically connected to the solenoid 42 for activation thereof. A switch 50 having a push button 52 is spring biased to an open position. The switch 50 is affixed to the underside 32 of the crown portion 12 with the push button 52 extending upwardly therethrough and is electrically connected to the battery 48. When the push button 52 is manually depressed the bill portion 14 will be placed in the angularly upright position 20 in which the indicia 22 becomes apparent. A liner 32 is place within the crown portion 12 to cover the arm 28*a*, solenoid 42, battery 48 and switch 50**.

Figure 3:
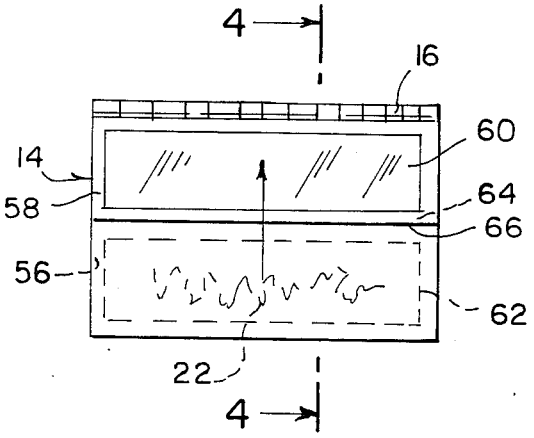
FIG. 3 is a front view taken in direction of arrow 3 in FIG. 2 showing a modified bill portion having an indicia viewing track therein.
Figure 4:
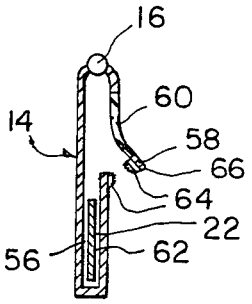
FIG. 4 is a cross sectional view taken along line 4—4 in FIG. 3 showing the track in greater detail.

As shown in FIGS. 3 and 4 the bill portion 14 can further contain a track 56 formed therein. A flap 58 is on the underside 24 of the bill portion 14 adjacent the pivot 16. The flap 58 has a transparent window 60 therein. A card 62 is provided having the indicia 22 thereon. The card 62 is slideable within the track 56 to be viewed through the window 60 when the bill portion 14 is placed in the angularly upright position 20. A VELCRO strip 64 is affixed between edge 66 of the flap 58 and the bill portion 14 so as to secure the flap 58 closed thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flip bill cap which comprises:

(a) a crown portion to be worn on a head of a person;

(b) a bill portion pivotally affixed to said crown portion and adapted to assume a downwardly extended position and an angularly upright position;

(c) indicia on the underside of said bill portion whereby when said bill portion is placed in the angularly upright position said indicia becomes apparent;

(d) means for placing said bill portion in the angularly upright position; wherein said angularly upright placing means includes;

(e) an arm extending inwardly into said crown portion from said bill portion;

(f) a solenoid having a shaft pivotally affixed to said arm, the shaft being spring biased outwardly to normally keep said bill portion in the downwardly extended position;

(g) a battery electrically connected to said solenoid for activation thereof;

(h) a switch having a push button a switch spring biased to an open position, affixed to the underside of said crown portion with the push button extending upwardly therethrough and electrically connected to said battery so that when the push button is manually depressed said bill portion will be placed in the angularly upright position in which said indicia becomes apparent and (i) a liner placed within said crown portion to cover said arm, solenoid, battery and switch.

* * * * *